US009295344B2

(12) United States Patent
Reinsel et al.

(10) Patent No.: US 9,295,344 B2
(45) Date of Patent: Mar. 29, 2016

(54) CUTLERY UTENSIL DISPENSER

(75) Inventors: Christopher M. Reinsel, Neenah, WI (US); Brian M. Durant, Kennesaw, GA (US); Michael R. Kilgore, Little Suamico, WI (US); Matthew K. F. Williquette, Sobieski, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 0 days.

(21) Appl. No.: 13/047,921

(22) Filed: Mar. 15, 2011

(65) Prior Publication Data

US 2011/0226797 A1 Sep. 22, 2011

Related U.S. Application Data

(60) Provisional application No. 61/315,561, filed on Mar. 19, 2010.

(51) Int. Cl.

| | |
|---|---|
| ***B65D 83/00*** | (2006.01) |
| ***A47F 1/10*** | (2006.01) |
| ***G07F 11/22*** | (2006.01) |

(52) U.S. Cl.

CPC . *A47F 1/10* (2013.01); *G07F 11/22* (2013.01); *A47F 2001/103* (2013.01)

(58) Field of Classification Search

CPC ..... A47F 2001/103; A47F 1/10
USPC ..... 221/195, 191, 194
See application file for complete search history.

(56) References Cited

U.S. PATENT DOCUMENTS

| | | | |
|---|---|---|---|
| 46,832 | A | 3/1865 | Thorne |
| 592,105 | A | 10/1897 | Barnes |
| D32,913 | S | 7/1900 | Graf |
| 703,718 | A | 7/1902 | Cammann |
| 716,058 | A | 12/1902 | Lang et al. |
| 925,485 | A | 6/1909 | Lafler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,261,835 | A | 4/1918 | Martin |
| 1,353,109 | A | 9/1920 | Carr |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Office Action for U.S. Appl. No. 12/349,203 mailed Jun. 15, 2011.
Peel Adhesion for Single Coated Pressure-Sensitive Tapes 180 Angle, Aug. 1989, pp. 21-22.
Tack Rolling Ball, Aug. 1989, pp. 29-30.
Holding Power of Pressure-Sensitive Tape, Aug. 1989, pp. 31-33.
Office Actions for U.S. Appl. No. 11/556,808, filed Nov. 6, 2006.
Office Action for U.S. Appl. No. 11/415,836, filed May 2, 2006.

(Continued)

*Primary Examiner* — Michael K Collins
(74) *Attorney, Agent, or Firm* — William W. Letson

(57) ABSTRACT

A cutlery utensil dispenser has a housing that includes a first zone for holding a utensil to be dispensed, a second zone for receiving the utensil during dispensing, and a third zone for delivering the dispensed utensil to a user. The first, second and third zones are cooperatively configured and adapted to maintain, and present to the user, one end of the utensil ahead of an opposing end of the utensil during a dispensing operation.

19 Claims, 11 Drawing Sheets

(56) References Cited

U.S. PATENT DOCUMENTS 1,355,583 A 10/1920 Zeidler et al.
1,546,077 A 12/1923 Hunter et al.
1,482,071 A 1/1924 Duff et al.
1,497,585 A 6/1924 Poole
1,504,098 A 8/1924 Cathey
1,547,151 A 7/1925 Watling
1,560,938 A 11/1925 Lund
1,577,302 A 3/1926 Schultz
1,610,001 A 12/1926 Foster
1,635,386 A 7/1927 Pierson
1,675,510 A * 7/1928 Nolan ..... 221/93
1,767,634 A 6/1930 Weiss
1,821,377 A 9/1931 Cusick
1,886,378 A 11/1932 Dearsley
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler, Sr.
2,141,684 A * 12/1938 Diemer ..... 221/239
2,149,098 A 2/1939 Phinney
2,149,099 A * 2/1939 Phinney et al. ..... 221/6
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A 1/1942 Hopkins et al.
2,328,486 A 8/1943 Painter
2,421,782 A 6/1947 Gibbs et al.
2,427,321 A 9/1947 Casey et al.
2,433,736 A 12/1947 Carew
2,472,051 A 5/1949 Testi
2,497,718 A 2/1950 Earley et al.
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,752,678 A 7/1956 Welch
2,800,013 A 7/1957 George
2,806,634 A 9/1957 Baumgartner
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,889,076 A 6/1959 Van Schie
2,911,127 A * 11/1959 Driss et al. ..... 221/258
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
2,965,262 A 12/1960 DuBois
3,037,257 A 6/1962 Girodet
3,052,006 A 9/1962 Jonas
3,083,879 A 4/1963 Coleman
3,095,114 A 6/1963 Tobias
3,100,842 A 8/1963 Tellefsen
3,114,475 A 12/1963 Etes
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,334,784 A 8/1967 Morrison
3,338,471 A 8/1967 De Good
3,371,821 A 3/1968 Abood, Jr.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Baller
3,499,538 A 3/1970 Sherard
3,558,006 A 1/1971 Redmond
3,587,922 A 6/1971 Oriti
3,654,396 A 4/1972 Biezeveld
3,680,736 A 8/1972 Viessman
3,710,535 A 1/1973 Walter
3,741,410 A 6/1973 Henschke et al.
3,747,803 A * 7/1973 Zoepf et al. ..... 221/251
3,786,959 A 1/1974 Greb et al.
3,851,762 A 12/1974 Liblick
3,861,563 A 1/1975 Lisbin
3,862,702 A 1/1975 Johnson et al.
3,897,886 A 8/1975 Franklin
3,932,978 A 1/1976 Kinney
3,972,118 A 8/1976 Richard
3,987,901 A 10/1976 Dullinger
4,043,203 A 8/1977 Montesi
4,048,915 A 9/1977 Martin
4,091,915 A 5/1978 Classen
4,120,662 A 10/1978 Fosslien
4,134,519 A * 1/1979 Barnett et al. ..... 221/46
4,146,123 A 3/1979 Cottrell
4,271,999 A 6/1981 Stravitz
4,288,003 A 9/1981 Fries
4,308,974 A 1/1982 Jones
4,317,284 A 3/1982 Prindle
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Michelson et al.
4,614,004 A 9/1986 Oshida
4,662,536 A 5/1987 Powers
4,666,060 A 5/1987 Bouldin
4,691,811 A 9/1987 Arakawa et al.
4,697,673 A 10/1987 Omata
4,707,251 A 11/1987 Jenkins
4,715,514 A 12/1987 Vidondo
4,789,064 A 12/1988 Segal
4,835,864 A 6/1989 Tang
4,863,033 A 9/1989 Buj
D305,709 S 1/1990 Blignaut
4,896,792 A 1/1990 Marchand
4,915,578 A 4/1990 Becker
4,921,106 A 5/1990 Spatafora et al.
4,950,120 A 8/1990 Barnes
4,961,684 A 10/1990 Provan et al.
4,963,072 A 10/1990 Miley et al.
4,973,037 A 11/1990 Holbrook
4,986,442 A 1/1991 Hinterreiter
4,995,154 A 2/1991 Bamber
D318,600 S 7/1991 Lillelund et al.
5,064,093 A 11/1991 Davis et al.
5,080,257 A 1/1992 Carnisio

(56) References Cited

U.S. PATENT DOCUMENTS

| | | | | |
|---|---|---|---|---|
| 5,127,546 | A | 7/1992 | Chen | |
| 5,131,586 | A | 7/1992 | Capy | |
| 5,161,268 | A | 11/1992 | Harrow | |
| 5,176,494 | A | 1/1993 | Nigrelli et al. | |
| 5,191,997 | A | 3/1993 | Squitieri | |
| 5,211,267 | A | 5/1993 | Clark | |
| 5,249,705 | A | 10/1993 | Gates | |
| D342,648 | S | 12/1993 | Cautereels et al. | |
| 5,269,397 | A | 12/1993 | Kawamoto et al. | |
| 2,340,561 | A | 2/1994 | Renfro | |
| 5,327,650 | A | 7/1994 | Rojas | |
| D351,085 | S | 10/1994 | Schmidt | |
| 5,364,016 | A | 11/1994 | Capy et al. | |
| 5,413,317 | A | 5/1995 | Spoerre | |
| D362,160 | S | 9/1995 | Brabeck et al. | |
| 5,449,054 | A | 9/1995 | Wiese et al. | |
| 5,460,252 | A | 10/1995 | Kosugi et al. | |
| 5,469,688 | A | 11/1995 | Dunbar et al. | |
| 5,479,708 | A | 1/1996 | Thomas | |
| 5,497,863 | A | 3/1996 | Schmidt et al. | |
| 5,509,522 | A | 4/1996 | Laidlaw | |
| 5,518,149 | A | 5/1996 | Lotspeich et al. | |
| 5,542,508 | A | 8/1996 | Van Erden et al. | |
| 5,564,594 | A | 10/1996 | Monfredo | |
| 5,586,685 | A | 12/1996 | Dorner et al. | |
| 5,590,472 | A | 1/1997 | Yaakov | |
| 5,605,208 | A | 2/1997 | Friedrichsen et al. | |
| 5,660,252 | A | 8/1997 | Lafon | |
| 5,762,211 | A | 6/1998 | Ensign | |
| 5,845,403 | A | 12/1998 | Nivin | |
| 5,853,092 | A | 12/1998 | Goodman et al. | |
| 5,904,250 | A | 5/1999 | DeSchutter | |
| 5,921,408 | A | 7/1999 | Groenewold et al. | |
| 5,933,918 | A | 8/1999 | Wallays | |
| 5,950,842 | A | 9/1999 | Baur | |
| 5,961,021 | A | 10/1999 | Koike et al. | |
| D420,887 | S | 2/2000 | Chen | |
| 6,023,913 | A | 2/2000 | Gray et al. | |
| D422,431 | S | 4/2000 | Goins | |
| 6,047,830 | A | 4/2000 | Chang | |
| 6,085,916 | A | 7/2000 | Kovacevic et al. | |
| 6,098,379 | A | 8/2000 | Spatafora et al. | |
| 6,115,921 | A | 9/2000 | Garneau | |
| 6,134,790 | A | 10/2000 | Watson | |
| 6,202,891 | B1 | 3/2001 | Mark | |
| 6,226,845 | B1 | 5/2001 | Fink | |
| 6,250,498 | B1 * | 6/2001 | Lovejoy | 221/185 |
| 6,289,889 | B1 | 9/2001 | Bell et al. | |
| 6,298,960 | B1 | 10/2001 | Derr | |
| 6,336,568 | B1 * | 1/2002 | Tucker et al. | 221/131 |
| 6,378,729 | B1 | 4/2002 | Kodama | |
| D458,070 | S | 6/2002 | Bennett et al. | |
| 6,399,079 | B1 | 6/2002 | Mehta et al. | |
| 6,412,398 | B1 | 7/2002 | Norcross et al. | |
| 6,415,465 | B1 | 7/2002 | Harrow | |
| 6,626,633 | B2 | 9/2003 | Jendzurski et al. | |
| 6,651,841 | B2 | 11/2003 | Tsuchida | |
| 6,749,074 | B1 | 6/2004 | Hileman et al. | |
| D492,549 | S | 7/2004 | Welch | |
| D493,337 | S | 7/2004 | Welch | |
| 6,763,972 | B2 | 7/2004 | Graupner | |
| 6,786,357 | B2 | 9/2004 | Renard | |
| 6,786,359 | B1 | 9/2004 | Schroeder | |
| 6,832,694 | B2 * | 12/2004 | Goeking et al. | 221/195 |
| 6,832,698 | B1 | 12/2004 | Dybul | |
| 6,837,028 | B1 | 1/2005 | Miano et al. | |
| 6,840,353 | B2 | 1/2005 | Arisaka | |
| 6,840,420 | B1 | 1/2005 | Hudson | |
| 6,880,211 | B2 | 4/2005 | Jackson et al. | |
| 6,895,672 | B2 | 5/2005 | Conforti | |
| 6,945,427 | B2 | 9/2005 | Hieb | |
| 6,972,033 | B2 | 12/2005 | McNicholas | |
| 6,976,348 | B1 | 12/2005 | Miano et al. | |
| 7,013,568 | B2 | 3/2006 | Schmidt | |
| 7,076,932 | B2 | 7/2006 | Rubin | |
| 7,090,455 | B2 | 8/2006 | Lamb | |
| 7,111,369 | B2 | 9/2006 | Ho | |
| D533,034 | S | 12/2006 | Wasserman | |
| 7,156,220 | B2 | 1/2007 | Olson et al. | |
| D536,222 | S | 2/2007 | Heiberg et al. | |
| 7,210,279 | B1 | 5/2007 | Ahmed et al. | |
| 7,237,700 | B2 | 7/2007 | Bulovic | |
| 7,322,172 | B2 | 1/2008 | Hoffman et al. | |
| D564,819 | S | 3/2008 | Fosburg et al. | |
| 7,412,808 | B2 | 8/2008 | Lavi | |
| D591,104 | S | 4/2009 | Oakes | |
| 7,513,089 | B2 | 4/2009 | Rubin | |
| 7,516,831 | B2 | 4/2009 | Chang | |
| 7,520,247 | B2 | 4/2009 | Rutledge | |
| 7,669,256 | B2 | 3/2010 | Harrow | |
| 7,716,842 | B2 | 5/2010 | Sumner-Trivisani et al. | |
| 7,731,899 | B2 | 6/2010 | Talmer et al. | |
| 7,819,234 | B2 | 10/2010 | Herzog | |
| 7,856,722 | B2 | 12/2010 | Lago-Arenas | |
| 8,070,013 | B2 * | 12/2011 | Reinsel et al. | 221/255 |
| 8,152,004 | B2 | 4/2012 | Smith et al. | |
| 8,210,364 | B2 * | 7/2012 | Smith et al. | 211/70.7 |
| 8,272,533 | B1 | 9/2012 | D'Amelia | |
| 8,296,957 | B2 | 10/2012 | Muehlemann | |
| 8,297,473 | B2 | 10/2012 | Smith | |
| 8,302,269 | B2 | 11/2012 | Pitman | |
| 8,360,273 | B2 | 1/2013 | Reinsel et al. | |
| 8,480,954 | B2 | 7/2013 | Talmer et al. | |
| 2002/0112445 | A1 | 8/2002 | Scaduto | |
| 2003/0015399 | A1 | 1/2003 | Bennett | |
| 2003/0015824 | A1 | 1/2003 | Forbes et al. | |
| 2003/0146061 | A1 | 8/2003 | Tourner | |
| 2004/0045398 | A1 | 3/2004 | Hayashi | |
| 2004/0045860 | A1 | 3/2004 | Edgerly et al. | |
| 2004/0089670 | A1 | 5/2004 | Goeking et al. | |
| 2004/0237311 | A1 | 12/2004 | Brown et al. | |
| 2005/0082307 | A1 | 4/2005 | Tucker | |
| 2005/0155186 | A1 | 7/2005 | McGuyer et al. | |
| 2005/0155229 | A1 | 7/2005 | Lee | |
| 2005/0252057 | A1 | 11/2005 | Lavi | |
| 2006/0000190 | A1 | 1/2006 | Behnke et al. | |
| 2006/0053638 | A1 | 3/2006 | Sumner-Trivisani et al. | |
| 2006/0218795 | A1 | 10/2006 | Santa Cruz et al. | |
| 2007/0035943 | A1 | 2/2007 | Wang | |
| 2007/0108141 | A1 * | 5/2007 | Smith et al. | 211/49.1 |
| 2007/0131705 | A1 | 6/2007 | Behravesh et al. | |
| 2007/0193968 | A1 * | 8/2007 | Smith et al. | 211/70.7 |
| 2007/0214650 | A1 | 9/2007 | Tomazini | |
| 2007/0250391 | A1 | 10/2007 | Prade et al. | |
| 2008/0121650 | A1 * | 5/2008 | Smith | 221/129 |
| 2008/0128445 | A1 | 6/2008 | Huang et al. | |
| 2009/0194557 | A1 | 8/2009 | Van Deursen | |
| 2010/0000096 | A1 | 1/2010 | Muehlemann | |
| 2010/0084418 | A1 | 4/2010 | Reinsel et al. | |
| 2010/0147869 | A1 | 6/2010 | Iliffe et al. | |
| 2010/0170915 | A1 | 7/2010 | Reinsel et al. | |
| 2011/0180562 | A1 | 7/2011 | Reinsel et al. | |
| 2011/0226797 | A1 * | 9/2011 | Reinsel et al. | 221/97 |
| 2011/0296693 | A1 | 12/2011 | Oakes | |
| 2012/0036724 | A1 | 2/2012 | Walters | |
| 2012/0047744 | A1 | 3/2012 | Walters | |
| 2012/0110746 | A1 | 5/2012 | Allard et al. | |
| 2012/0145734 | A1 | 6/2012 | Walters | |
| 2012/0145735 | A1 | 6/2012 | Erickson et al. | |
| 2012/0145736 | A1 | 6/2012 | Walters et al. | |
| 2013/0032609 | A1 | 2/2013 | Righetti et al. | |
| 2013/0043272 | A1 | 2/2013 | Oakes | |
| 2013/0134211 | A1 | 5/2013 | Linkel | |
| 2013/0152406 | A1 | 6/2013 | McFarland | |
| 2013/0193157 | A1 | 8/2013 | Jongen et al. | |
| 2014/0069930 | A1 | 3/2014 | Oakes | |
| 2014/0191024 | A1 | 7/2014 | Wnek et al. | |
| 2014/0217112 | A1 | 8/2014 | Young et al. | |

FOREIGN PATENT DOCUMENTS

| | | |
|---|---|---|
| CN | 101495015 A | 7/2009 |
| DE | 7033238 | 11/1970 |
| DE | 7127677 | 11/1971 |

(56) References Cited

FOREIGN PATENT DOCUMENTS

| | | | |
|---|---|---|---|
| DE | 3151268 | | 7/1983 |
| DE | 4139938 | A1 | 6/1993 |
| DE | 9316566 | U1 | 1/1994 |
| DE | 19906369 | C1 | 2/2000 |
| DE | 202005013647 | U1 | 7/2006 |
| EP | 0257109 | A1 | 8/1986 |
| EP | 0856272 | A3 | 1/1999 |
| EP | 1022107 | A1 | 7/2000 |
| EP | 1217923 | B1 | 9/2003 |
| EP | 1358827 | | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | JH06121727 | A | 5/1994 |
| JP | 08-047440 | | 2/1996 |
| JP | 2007-319493 | | 12/2007 |
| KR | 20-1991-0008085 | | 10/1991 |
| KR | 10-2009-0071515 | A | 7/2009 |
| WO | 01/05280 | A1 | 1/2001 |
| WO | 01/05281 | A1 | 1/2001 |
| WO | 01/68492 | A1 | 9/2001 |
| WO | 2004/028309 | A1 | 4/2004 |
| WO | 2007/049982 | A1 | 5/2007 |
| WO | 2007/124606 | A1 | 11/2007 |
| WO | 2008/058187 | A3 | 5/2008 |
| WO | 2009137367 | A2 | 11/2009 |

OTHER PUBLICATIONS

Office Actions for U.S. Appl. No. 11/936,401, filed Nov. 7, 2007.

European Search Report for 060009258.2, mailed Jul. 24, 2006, five mages, Munich, Germany.

PCT International Search Report and Written Opinion PCT/US2007/083752, Mar. 11, 2008, 10 pages.

European Search Report for EP 08 014 387.8, mailed Nov. 11, 2008, four pages, European Patent Office, Munich, Germany.

International Search Report and Written Opinion for PCT/US2009/059915, Mailed Feb. 3, 2010, 13 pages, European Patent Office, Munich, Germany.

International Search Report and Written Opinion for PCT/US2011/044931, mailed Feb. 28, 2012.

International Search Report and Written Opinion for PCT/US2011/044934, mailed Mar. 6, 2012.

International Search Report and Written Opinion for PCT/US2011/058329.

International Search Report and Written Opinion for PCT/US2011/058767, dated Feb. 29, 2012.

International Search Report and Written Opinion for PCT/US2011/064057, dated Feb. 29, 2012.

Supplementary European Search Report for EP 11 79 3088 dated Sep. 25, 2013.

International Search Report and Written Opinion for PCT/US2007/083922 mailed Nov. 17, 2008, 10 pages.

* cited by examiner

CUTLERY UTENSIL DISPENSER

CROSS-REFERENCE TO RELATED APPLICATION

This application claims priority to U.S. Provisional Patent Application Ser. No. 61/315,561 filed Mar. 19, 2010, the disclosure of which is incorporated herein in its entirety by this reference.

BACKGROUND OF THE INVENTION

The present disclosure relates generally to a cutlery utensil dispenser, and particularly to a compact cutlery utensil dispenser that presents the handle of the dispensed cutlery to a user.

The present disclosure relates generally to a cutlery utensil dispenser, and particularly to a compact cutlery utensil dispenser that presents the handle of the dispensed cutlery to a user.

Eating facilities often provide cutlery utensils in dispensing bins, where all customers place their hands into the bins in order to retrieve a knife, fork, spoon or spork. While such arrangements provide for economical dispensing of cutlery utensils, as opposed to sets of utensils being separately wrapped in plastic sleeves, the open air bins are not very hygienic, and can spread hand-carried bacteria and the like to other utensils in the bin or potentially to another customer.

In an attempt to address concerns relating to the dispensing of hygienic cutlery utensils, enclosed dispensers have been employed where a stack of cutlery utensils are placed in a utensil compartment and dispensed one at a time on command by operation of a dispensing lever. Such arrangements may be suitable for their intended purpose, but are also bulky and occupy valuable counter top space needed for other purposes. One remedy to such a deficiency may be to simply move the dispenser to a counter top in an area seeing less traffic. However, such a dispenser would defeat the purpose of being conveniently located. In view of these and other deficiencies, there is a need in the art for an improved cutlery utensil dispenser.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment of the invention includes a cutlery utensil dispenser having a housing that includes a first zone for holding a utensil to be dispensed, a second zone for receiving the utensil during dispensing, and a third zone for delivering the dispensed utensil to a user. The first, second and third zones are cooperatively configured and adapted to maintain, and present to the user, one end of the utensil ahead of an opposing end of the utensil during a dispensing operation.

BRIEF DESCRIPTION OF THE DRAWINGS

Referring to the exemplary drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

An embodiment of the invention, as shown and described by the various figures and accompanying text, provides a compact cutlery utensil dispenser that presents the handle of the dispensed cutlery to the user, thereby reducing the likelihood of the utility portion of the dispensed cutlery being touching by another person, which serves to improve the overall hygiene of the cutlery dispensing process. While embodiments described herein depict the dispensing of a knife as an example piece of cutlery, it will be appreciated that the disclosed invention is also applicable to other types of cutlery, such as a fork, spoon, or spark (combination of spoon and fork in one utensil), for example.

Figure 2:
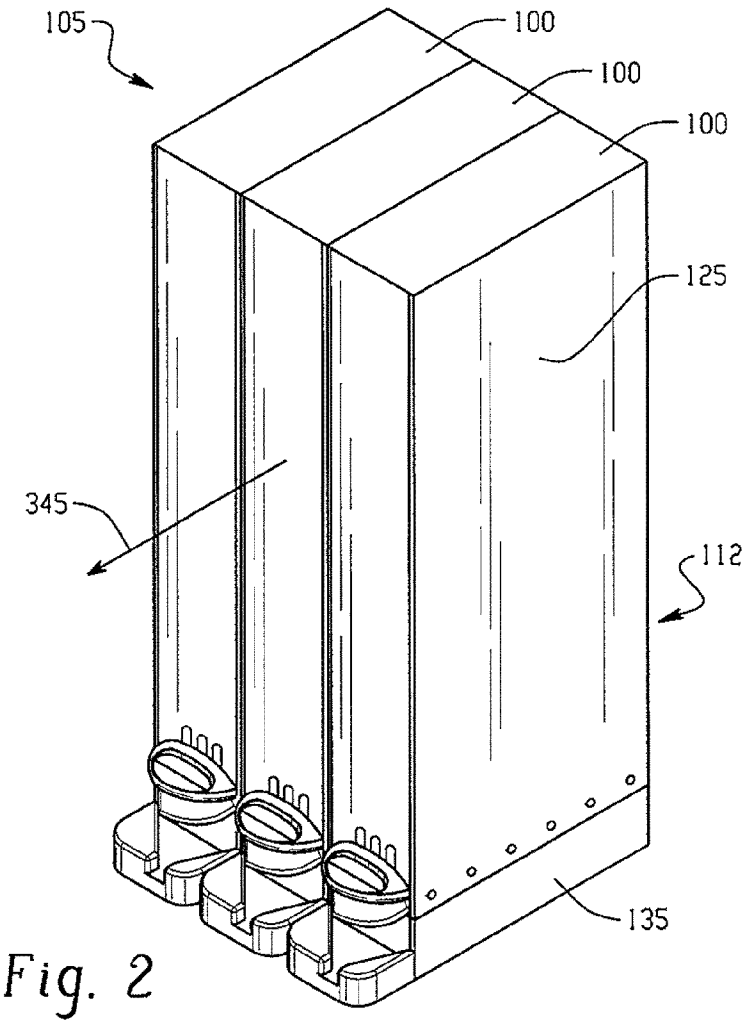
FIG. 2 depicts in right side isometric view an example three-gang dispenser in accordance with an embodiment of the invention.
Figure 1:
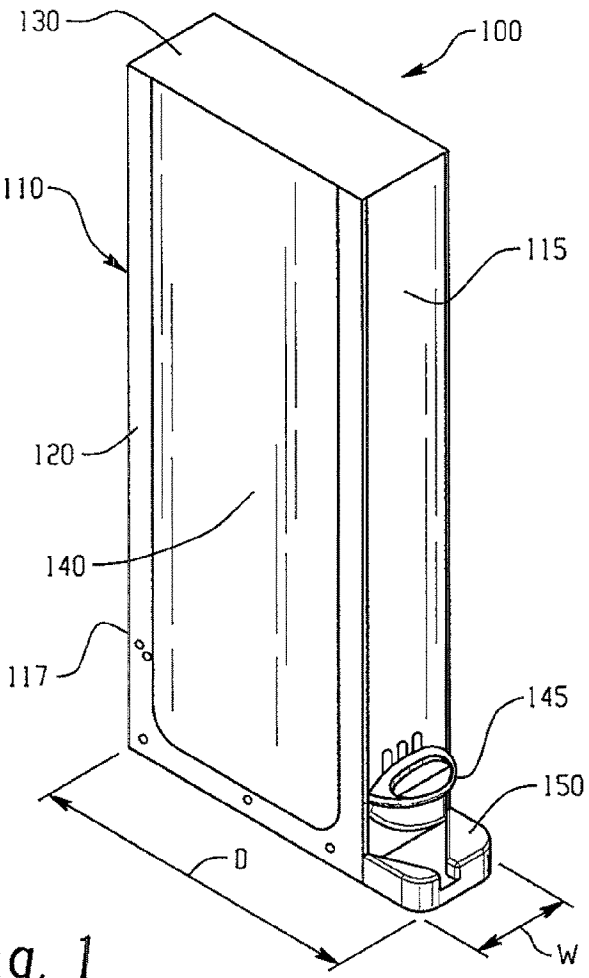
FIG. 1 depicts in left side isometric view an example single dispenser in accordance with an embodiment of the invention.
Figure 3:
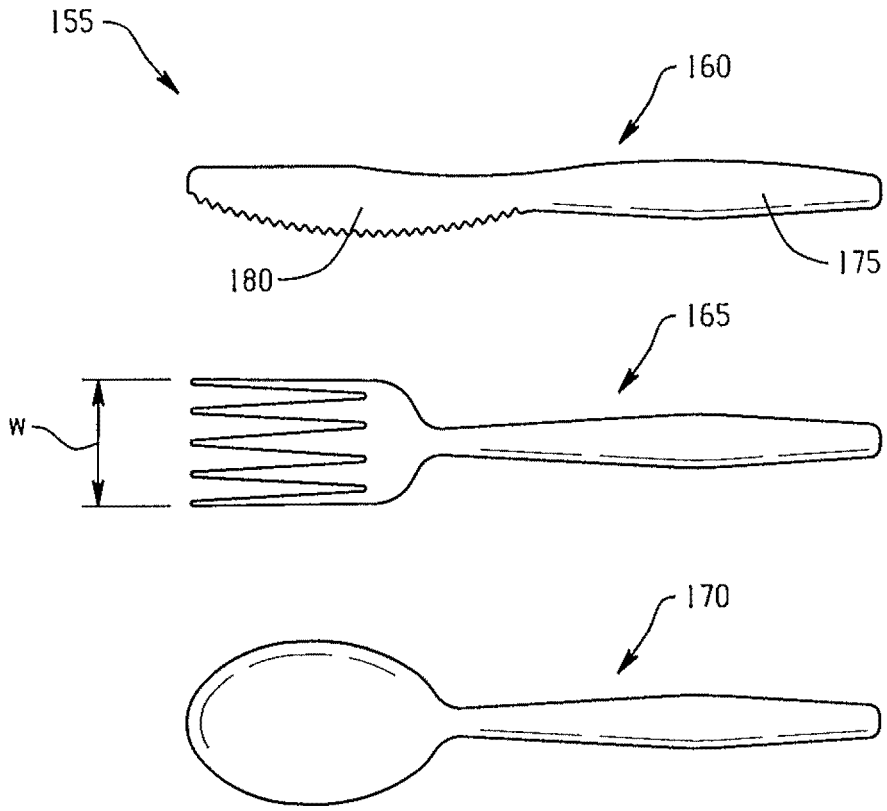
FIG. 3 depicts in plan view example cutlery utensils for use in accordance with an embodiment of the invention.

FIG. 1 depicts an example embodiment of a single dispenser 100, and FIG. 2 depicts an example embodiment of three side-by-side dispensers 100 as a combination unit 105. Dispenser 100 includes a housing 110 having a front panel 115, a back panel 117, a left panel 120, a right panel 125, a top panel 130, and a base 135. In an embodiment, the left panel 120 includes a door 140 that can be opened and closed, and the top panel 130 can be opened and closed, for stocking a new stack of cutlery utensils inside the dispenser 100. A dispensing handle 145 and a dispensing tray 150 are disposed at the front of the dispenser 100 toward the bottom of the front panel 115 for delivering a dispensed cutlery to a user, which will be discussed in more detail below. Example cutlery utensils 155 are depicted in FIG. 3, such as a knife 160, a fork 165 and a spoon 170, which in an embodiment are made from a plastic suitable for the purposes disclosed herein. Each piece of cutlery 155 includes a handle portion 175 and a utility portion 180.

In an embodiment where it is desirable to permanently secure dispenser 100 to a support surface such as a cafeteria counter top, everything but the base 135 of each dispenser 100 may be formed as an upper unit 112, where a sliding door type runner arrangement is disposed between the upper unit 112 and the base 135 of each dispenser 100 to allow the upper unit 112 of each dispenser 100 to slide forward (see arrow 345 in FIG. 2) to permit restocking of utensils 155 in each dispenser 100 individually via hinged side door 140 or hinged top panel 130. While an embodiment has been disclosed having an upper unit 112 capable of being slid forward from the base 135 for restocking, it will be appreciated that the scope of the invention is not limited to only a forward sliding action, but also encompasses other means of accessing the interior of dispenser 100, such as for example, by lifting the upper unit 112 off of the base 135, rotating the upper unit 112 with respect to the base 135 in any suitable direction about any suitable pivot axis, or by translating the upper unit 112 with respect to the base 135 in any suitable direction, for the purpose of restocking.

Figure 5:
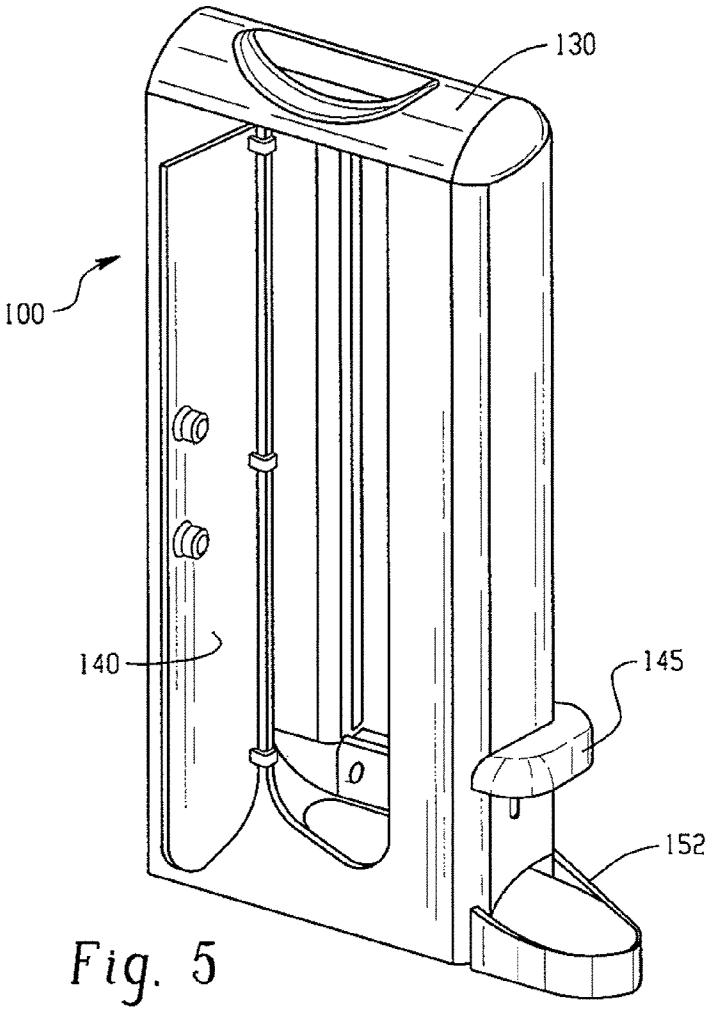
FIGS. 4 and 5 depict in left side isometric view example dispensers in accordance with an embodiment of the invention.
Figure 4:
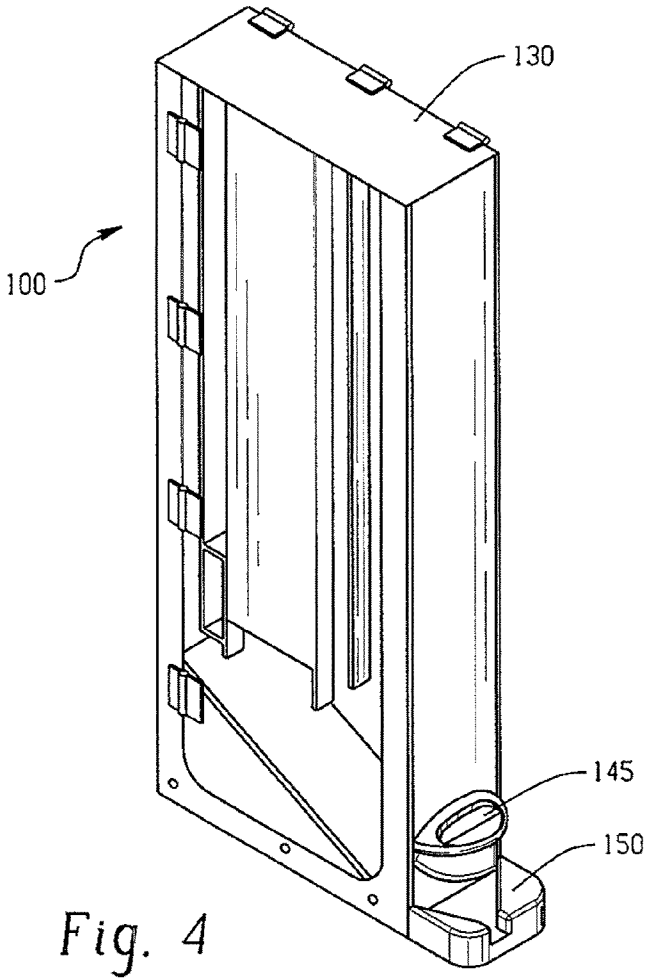

FIGS. 4 and 5 depict similar dispensers 100 but with different dispensing trays. In FIG. 4, the dispensing tray is similar to that depicted in FIGS. 1 and 2, and is herein referred to by reference numeral 150. In FIG. 5, an alternative dispensing tray is depicted, which is herein referred to by reference numeral 152. FIGS. 4 and 5 also better illustrate the door 140 (door removed in FIG. 4) and openable top panel 130. By depressing the handle 145 in a manner to be discussed below, a piece of cutlery 155 is dispensed to the dispensing tray 150, 152 with its handle portion 175 being presented ahead of its utility portion 180 to an end user, best seen by referring to FIG. 6.

Figure 7:
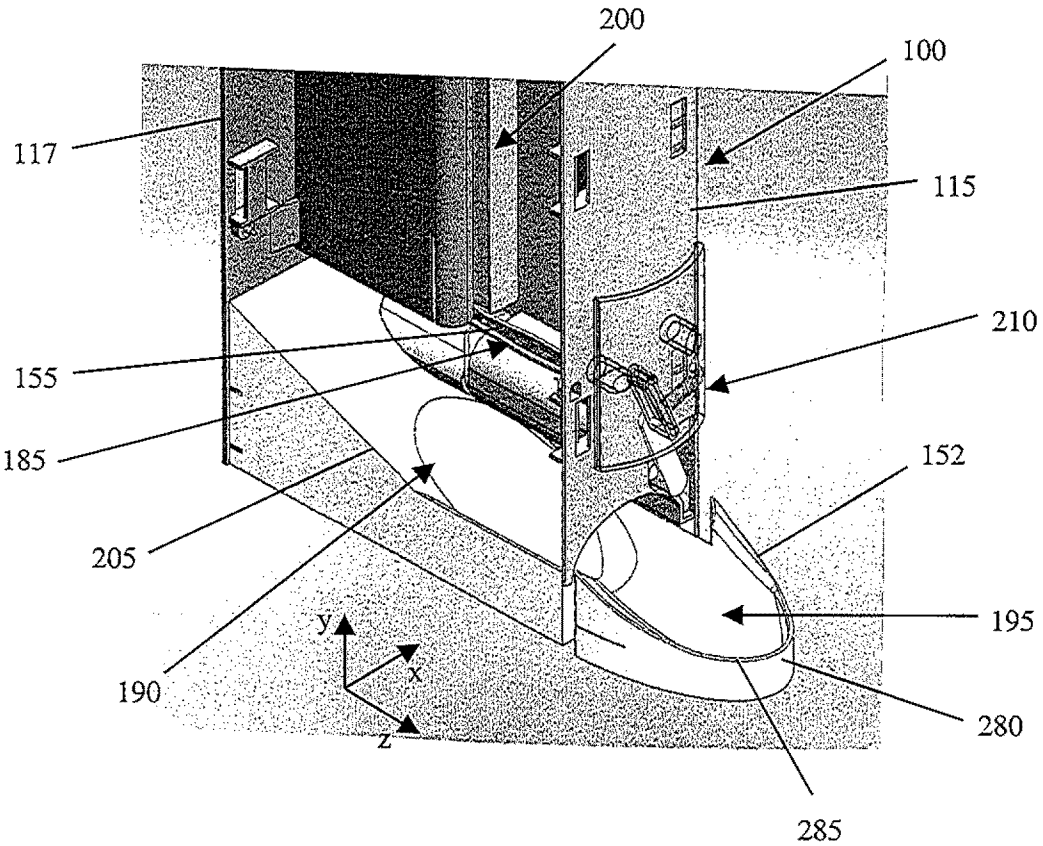
FIG. 7 depicts in left side isometric view portions of an example dispenser in accordance with an embodiment of the invention.

Referring now to FIG. 7, dispenser 100 includes a storage area 200 for storing a stack of cutlery utensils 155 for one-at-a-time dispensing, a first zone 185 where the next-in-line utensil 155 is disposed ready to be dispensed, a second zone 190 for receiving the utensil 155 during dispensing, and a third zone 195 for delivering the dispensed utensil 155 to a user. The third zone 195 may herein alternatively be referred to as the dispensing tray 150, 152.

As will be appreciated by the size and configuration of the dispenser 100 disclosed herein, the stacking arrangement of a stack of cutlery 155 in the housing 110 of the dispenser 100, and the presentation of the handle portion 175 of a dispensed utensil 155 to a user, each of the first zone 185, the second zone 190 and the third zone 195 are cooperatively adapted and configured to maintain, and present to the user, one end of the utensil 155 ahead of an opposing end of the utensil 155 during a dispensing operation, and are cooperatively adapted and configured to maintain a major axis of the utensil 155 substantially parallel with a same plane, such as the y-z plane depicted in FIG. 7, during a dispensing operation, where the length of the utensil 155 defines the direction of the major axis of the utensil 155, and where the length of the utensil 155 extends from the front panel 115 to the back panel 117 parallel to the z-axis for example (seen by referring to the orientation of utensil 155 in first zone 185 in FIG. 7).

As illustrated, the second zone 190 is offset from the first zone 185 in a first direction (negative-x-direction for example), and the third zone 195 is offset from the second zone 190 in a second direction (positive-z-direction for example) orthogonal to the first direction. A ramp 205 located at the second zone 190 serves to receive and direct a dispensed utensil 155 toward the third zone 195 under the influence of gravity. In this manner, a next-in-line utensil 155 to be dispensed travels in succession from the first zone 185 in the negative-x-direction toward the second zone 190, and then toward the third zone 195 in the positive-z-direction during a dispensing operation. The x-y-z coordinate axes depicted in FIG. 7 is for discussion purposes only, and is not intended to be limiting in any way.

Figure 8:
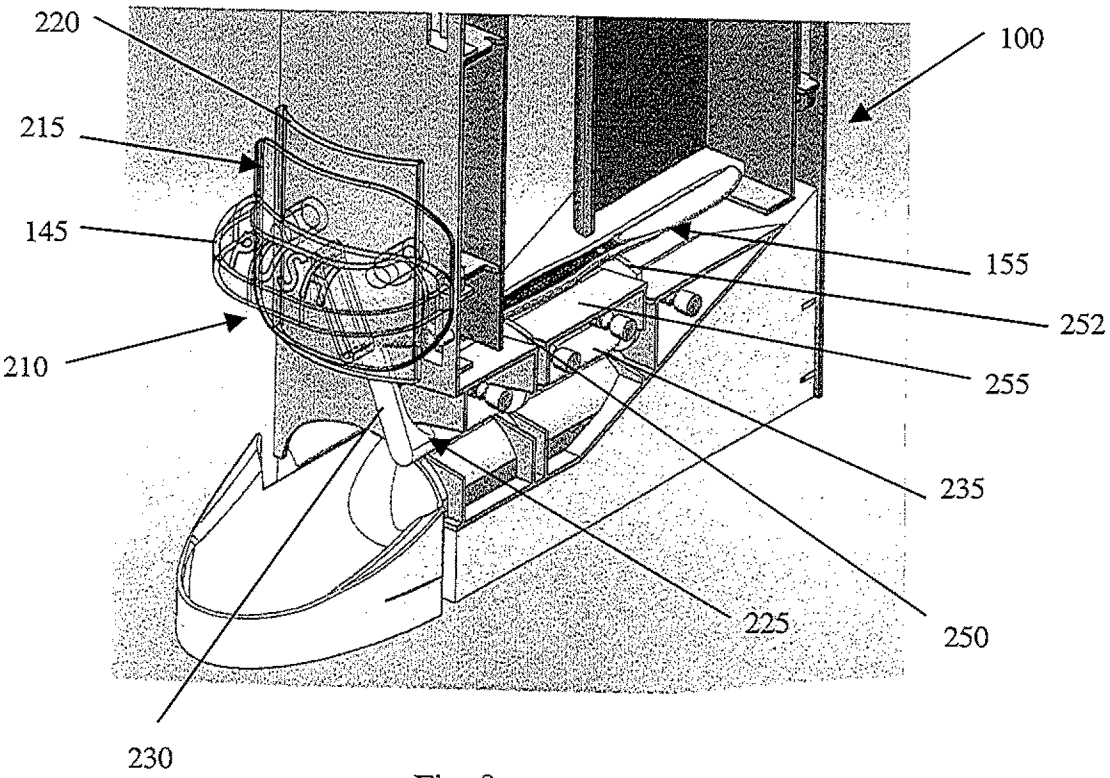
FIG. 8 depicts in right side isometric view portion of an example dispenser in accordance with an embodiment of the invention.

A dispensing mechanism 210 is actuated from the front of the dispenser 100 for dispensing a next-in-line utensil 155 when actuated, which is best seen by now referring to FIG. 8. In an embodiment, the dispensing mechanism 210 includes a driving member 215 (handle 145 having a slide plate 220 for example) operably coupled to a driven member 225 (crank arm 230 coupled to a crank 235 for example), which in turn is operably disposed to dispense a next-in-line utensil 155 upon actuation of the driving member 215 by sliding the handle 145 in the negative-y-direction.

Figure 9:
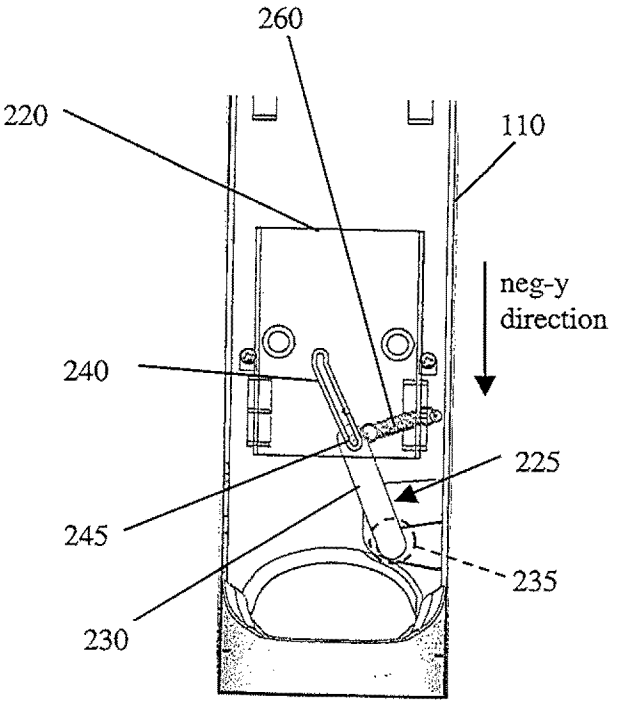
FIG. 9 depicts in front view portions of an example dispenser showing portions of the operating mechanism in accordance with an embodiment of the invention.
Figure 10:
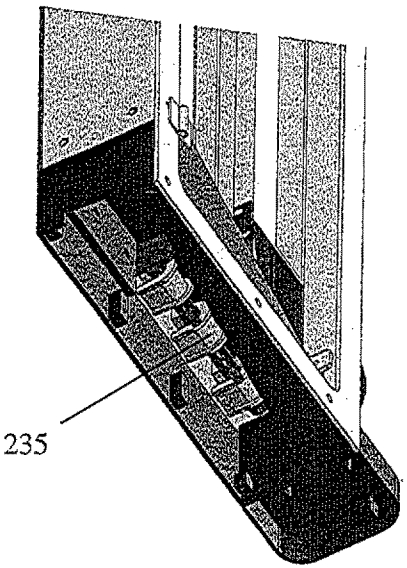
FIG. 10 depicts in bottom isometric view portions of an example dispenser showing portions of the operating mechanism in accordance with an embodiment of the invention.
Figure 11:
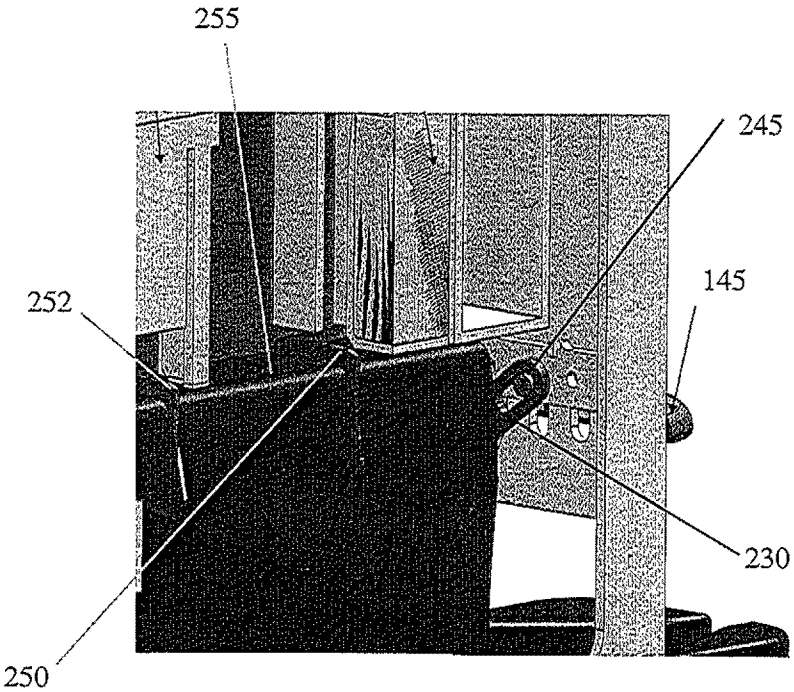
FIG. 11 depicts in left side isometric view portions of an example dispenser showing portions of the operating mechanism in accordance with an embodiment of the invention.
Figure 12:
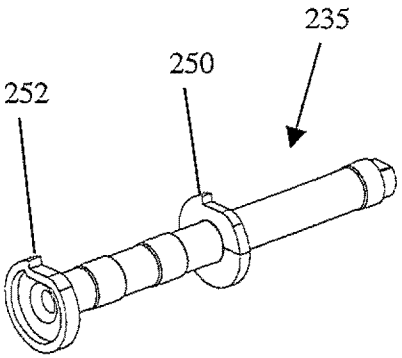
FIG. 12 depicts in isometric view a crank for use in a dispenser in accordance with an embodiment of the invention.

Referring now to FIG. 9, the slide plate 220 of the handle 145 (depicted in FIG. 8) includes a cam surface 240, depicted in FIG. 9 as a slot, and the crank arm 230 of the driven member 225 includes a can follower 245, depicted in FIGS. 9 and 11 as a pin, disposed in operable engagement with the slot 240. In the embodiment depicted, the pin 245 engages the slot 240. While an embodiment has been disclosed having a cam surface 240 and cam follower 245 as a means for actuating the dispensing mechanism 210, it will be appreciated that the scope of the invention is not so limited, and also encompasses other means for actuating the dispensing mechanism 210, such as by a rack and pinion gear arrangement, a linkage arrangement, or an intermediate drive spring arrangement, for example.

Referring to FIGS. 8-12 collectively, the crank 235 includes at least one dispensing finger 250, 252 proximate the next-in-line utensil 155 that is disposed upon a platform 255 in the first zone 185. In response to translation actuation of the handle 145 in the negative-y-direction, interaction between the cam surface (slot) 240 and the cam follower (pin) 245 causes counter-clockwise rotation of the crank 235 (as viewed from the perspective of FIG. 9) and dispensing engagement of the at least one finger 250, 252 with the next-in-line utensil 155. Crank 235 is pivotally attached to the housing 110 by any means suitable for the purposes disclosed herein.

With reference primarily to FIG. 9, an extension spring 260 is anchored between the crank arm 230 of the driven member 225 and the housing 110, which biases the crank 235 in a clockwise direction (as viewed from the perspective of FIG. 9), which in turn biases the driving member 215 in the positive-y-direction via the cam surface (slot) 240 and cam follower (pin) 245 interaction. As such, the driving member 215 can be said to be biased in the positive-y-direction toward a first position, a rest position, and to be actuatable in the negative-y-direction toward a second position to dispense the next-in-line utensil. When the driving member 215 is disposed at its rest position, the driven member 225 is disposed at its respective rest position, and when the driving member 215 is disposed at the second position, the spring 260 biases both the driven member 225 and the driving member 215 toward their respective rest positions.

While embodiments depicted herein utilize an extension spring 260 as a biasing means, it will be appreciated that the invention is not limited to only the use of an extension spring, but may alternatively employ any biasing means suitable for the purposes disclosed herein, such as a torsion spring, a compression spring, a cantilevered spring, or a self-resetting dashpot, for example. Any and all biasing means suitable for the purposes disclosed herein are considered within the scope of the invention when used for the purposes disclosed herein.

Figure 6:
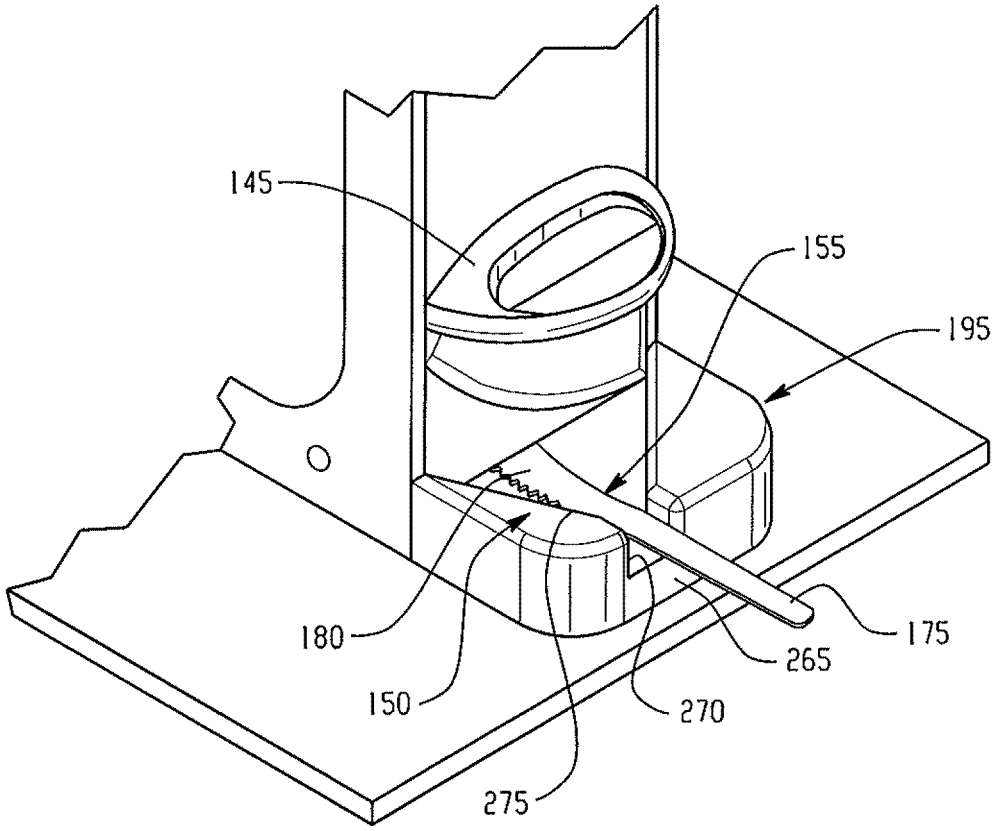
FIG. 6 depicts in left side isometric view a portion of an example dispenser in accordance with an embodiment of the invention.

As discussed above and with reference now to FIGS. 6 and 7, the dispensing tray 150, 152 at the third zone 195 may have more than one configuration. One configuration, such as tray 150 for example, has an end wall 265 with an opening 270 therethrough for receiving the handle portion 175 of a dispensed utensil 155 therein during a dispensing operation. Another configuration, such as tray 152 for example, has a closed end wall 280 for stopping the movement of utensil 155 during a dispensing operation. In the embodiment depicted in FIG. 6, dispensing tray 150 has a necked-down side-wall profile 275 to promote transport of the handle portion 175 of utensil 155 into opening 270 during a dispensing operation. In the embodiment depicted in FIG. 7, dispensing tray 152 has a curved profile 285 to end wall 280 to promote transport of the end of handle portion 175 of utensil 155 close to a user. The two tray configurations 150, 152 depicted in FIGS. 6 and 7 are presented in a non-limiting manner as illustrative example embodiments only. As such, other configurations for trays 150, 152 and end walls 265, 280 that meet the spirit of the purposes disclosed herein are considered within the scope of the claimed invention. For example, necked-down side-wall profile 275 of dispensing tray 150 may be angled with straight lines, or contoured with curved lines, and curved profile 285 of dispensing tray 152 may have uniform curvature or non-uniform curvature, or may be angled with straight lines.

Figure 13:
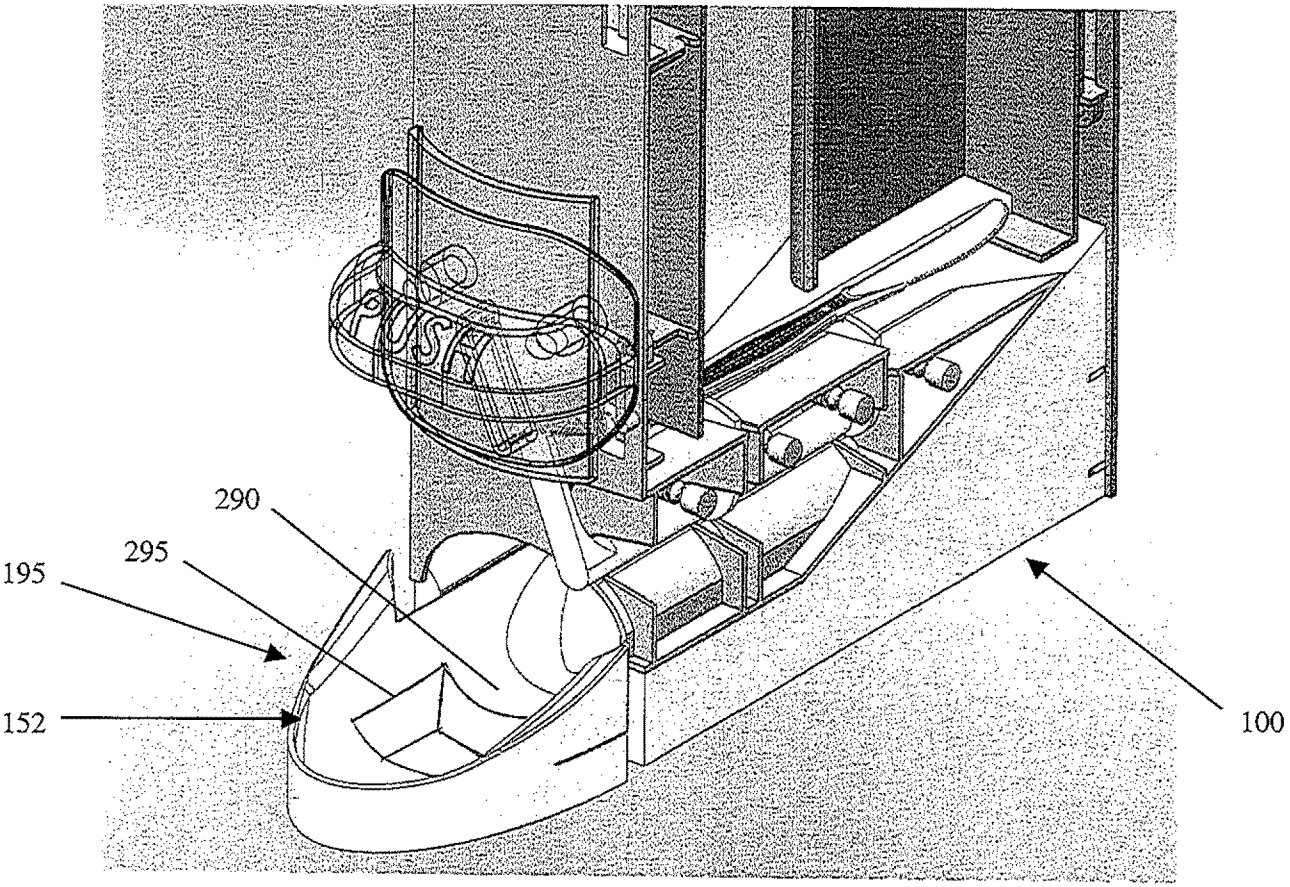
FIG. 13 depicts in right side isometric view the dispenser of FIG. 8 having an alternative dispensing tray in accordance with an embodiment of the invention.

Referring now to FIG. 13, an embodiment of the dispensing tray 152 includes a floor 290 with a pocket 295 disposed therein, which is so configured and dimensioned as to allow a user's fingers to extract a dispensed utensil 155 from the tray 152 without touching a surface of the tray floor 290 supporting the dispensed utensil 155, thereby further improving the hygiene of the cutlery dispensing system. While only one pocket 295 is depicted in FIG. 13, it will be appreciated that the scope of the invention is not so limited and also includes a floor 290 having more than one pocket 295 separated by ribs (sections of the floor between adjacent pockets) for example.

Figure 14:
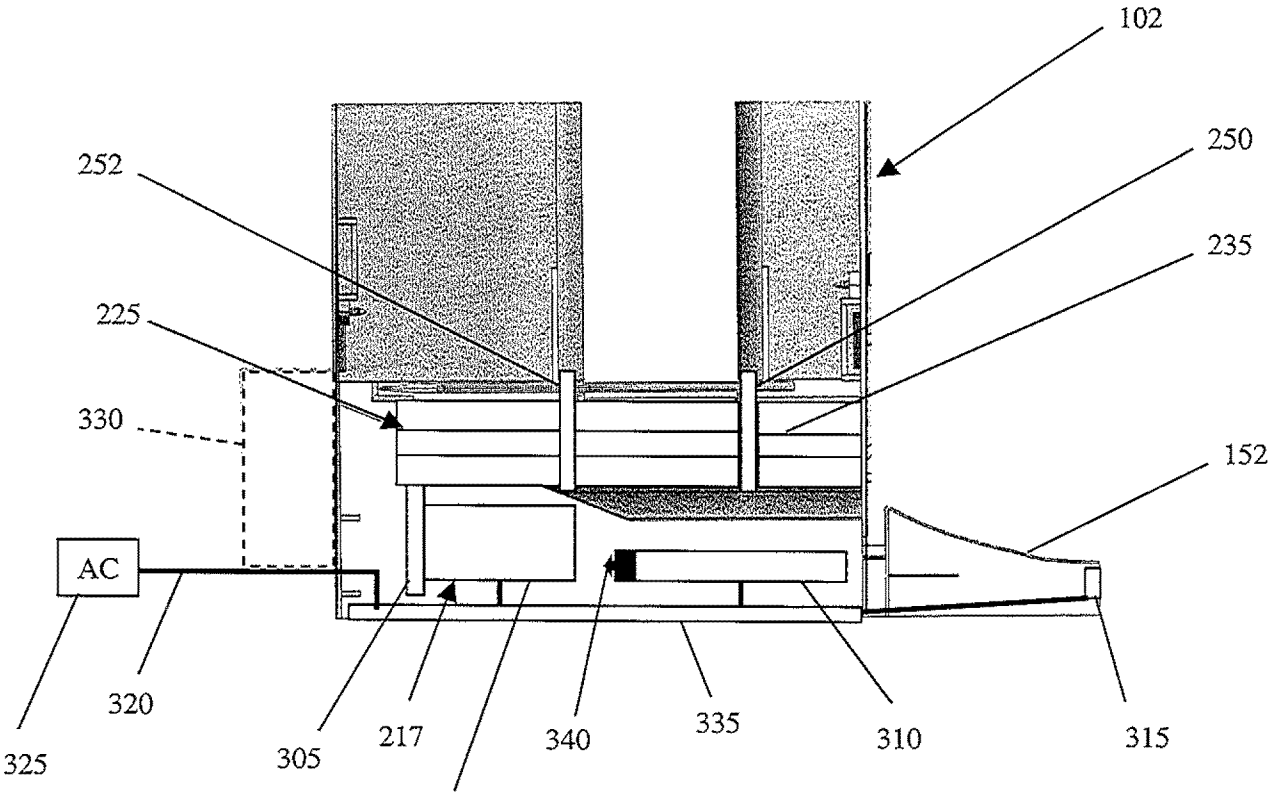
FIG. 14 depicts in left side view a motorized dispenser in accordance with an embodiment of the invention.

Referring now to FIG. 14, another embodiment of the invention includes a dispenser 102 having a driving member 217 with a motor 300 in operable engagement with the driven member 225 via a gear set 305. In an embodiment, a microprocessor driven controller 310 is responsive to a proximity sensor 320, such as an infrared sensor responsive to the presence of a user's hand for example, for actuating the motor 300 to dispense a next-in-line utensil 155 via rotation of crank 235 and movement of fingers 250, 252 in the manner described above. Power for the dispenser 102 may be provided by a power line 320 connected to a source of mains AC power 325, or alternatively connected to a DC battery 330. In an embodiment employing a DC battery 330, a grounding path may be provided in order to discharge buildup of static electricity. A power/communication bus 335 may be employed to provide signal connection and communication between the various control and drive components of dispenser 102 via the several signal lines illustrated therebetween in FIG. 14. Alternatively, signal connection and communication may be provided by individual connections between the various control and drive components, thereby removing the need for a separate bus, depending on manufacturing considerations and preferences. For example, individually outsourced components with common connection configurations could be plugged into a common bus at a separate assembly facility, thereby standardizing and streamlining manufacturing processes. While an embodiment has been disclosed having an infrared sensor as a proximity sensor 320, it will be appreciated that the scope of the invention is not limited to only infrared sensors, and also encompasses the use of other proximity sensors suitable for the purpose disclosed herein, such as a capacitive sensor, or a manually operated switch, for example.

Comparing the manually driven dispenser 100 of FIGS. 1-13 with the motor driven dispenser 102 of FIG. 14, it will be appreciated that all of the foregoing description of operation is applicable to the manual dispenser 100 and the motor driven dispenser 102 alike with the exception of the means for actuating a dispensing operation.

In an embodiment, proximity sensor 320 is oriented sensing outward so as to sense the presence of a user's hand requesting a utensil, which is referred to as on-demand dispensing or operating in an on-demand mode. In another embodiment, proximity sensor 320 is oriented sensing inward toward the dispensing tray 152 so as to sense the absence of a utensil 155 in the dispensing tray 152, which is referred to as missing-utensil dispensing or operating in a missing-utensil mode. In an embodiment, controller 310 is equipped with a switch 340 to enable an authorized operator of dispenser 102 to switch the setup between on-demand mode and missing-utensil mode as desired by the facility operators in which dispenser 102 is utilized. Switch 340 may be any kind of switch suitable for the purpose disclosed herein, such as a toggle switch, a rotary switch, or jumper wires, for example, and is not limited to only a two-position switch, but also encompasses a multi-position switch such as a three-pole switch for example, which would enable multiple dispensing modes to be activated (on-demand mode activated, missing-utensil mode activated, or both modes activated, for example).

In illustrated in the various figures, dispenser 100, 102 has a particular aspect ratio of width (W), along the x-direction, to depth (D), along the z-direction (with reference to FIGS. 1 and 7), that provides for a compact presence and reduced footprint on a counter top as compared to other utensil dispensers that dispense cutlery 155 sideways, that is, not with the handle portion 175 presented ahead of the utility portion 180 as described herein. From the foregoing description, it will be appreciated that the width (W) of dispenser 100, 102 is primarily determined by the width of the first zone 185 plus the width of the second zone 190 utilized in the housing 110. In an embodiment, the width (W) is equal to or less than three times the width (w) of a utensil 155 suitable for dispensing in dispenser 100, 102 (see width, w, in FIG. 3). As can be seen by reference to FIG. 3, a knife 160, a fork 165 and a spoon 170, may have different overall widths (w). Thus, the ratio of W/w is determined by the largest utensil width (w), a fork for example, suitable for dispensing in dispenser 100, 102. In an embodiment, the ratio of W/w is greater than one and equal to or less than seven.

In view of dispenser 102 having a controller 310, it will be appreciated that an embodiment of the invention may be embodied in the form of computer-implemented processes and apparatuses for practicing those processes. The present invention may also be embodied in the form of a computer program product having computer program code containing instructions embodied in tangible media, such as floppy diskettes, CD-ROMs, hard drives, USB (universal serial bus) drives, or any other computer readable storage medium, such as random access memory (RAM), read only memory (ROM), erasable programmable read only memory (EPROM), electrically erasable programmable read only memory (EEPROM), or flash memory, for example, wherein, when the computer program code is loaded into and executed by a computer/controller, the computer/controller becomes an apparatus for practicing the invention. The present invention may also be embodied in the form of computer program code, for example, whether stored in a storage medium, loaded into and/or executed by a computer/controller, or transmitted over some transmission medium, such as over electrical wiring or cabling, through fiber optics, or via electromagnetic radiation, wherein when the computer program code is loaded into and executed by a computer/controller, the computer/controller becomes an apparatus for practicing the invention. When implemented on a general-purpose microprocessor, the computer program code segments configure the microprocessor to create specific logic circuits. A technical effect of the executable instructions is to dispense cutlery utensils via an on-demand mode or a missing-utensil mode in an improved hygienic manner.

The particular and innovative arrangement of components according to the invention therefore affords numerous not insignificant technical advantages in addition to an entirely novel and attractive visual appearance.

In view of the foregoing, it will be appreciated that at least nineteen embodiments of the invention in various combinations fall within the ambit of the disclosed invention, and are summarized below. It will also be appreciated that other embodiments of the invention involving other combinations not specifically summarized below may also fall within the ambit of the disclosed invention.

A first embodiment of the invention includes a cutlery utensil dispenser having a housing that includes a first zone for holding a utensil to be dispensed, a second zone for receiving the utensil during dispensing, and a third zone for delivering the dispensed utensil to a user. The first, second and third zones are cooperatively configured and adapted to maintain, and present to the user, one end of the utensil ahead of an opposing end of the utensil during a dispensing operation.

A second embodiment of the invention includes a cutlery utensil dispenser according to the first embodiment, wherein each of the first zone, the second zone and the third zone are adapted and configured to maintain a major axis of the utensil substantially parallel with a same plane, the second zone being offset from the first zone in a first direction, and the third zone being offset from the second zone in a second direction orthogonal to the first direction.

A third embodiment of the invention includes a cutlery dispenser according to any of the first and second embodiments, wherein a next-in-line utensil to be dispensed passes in succession from the first zone to the second zone to the third zone during a dispensing operation.

A fourth embodiment of the invention includes a cutlery dispenser according to any of the first through third embodiments, wherein the third zone is adapted and configured to present a handle portion of the utensil to the user ahead of a utility portion of the utensil.

A fifth embodiment of the invention includes a cutlery dispenser according to any of the first through fourth embodiments, wherein the second zone includes a ramp configured and disposed to dispense the utensil toward the third zone under the influence of gravity.

A sixth embodiment of the invention includes a cutlery dispenser according to any of the first through fifth embodiments, further including a dispensing mechanism having a driving member operably coupled to a driven member, the driven member being operably disposed to dispense a next-in-line utensil upon actuation of the driving member.

A seventh embodiment of the invention includes a cutlery dispenser according to the sixth embodiment, wherein the driving member includes a manually actuatable handle, the driven member includes a crank having a crank arm coupled to the handle, and in response to actuation of the handle, the crank is actuated via the crank arm to dispense the next-in-line utensil.

An eighth embodiment of the invention includes a cutlery dispenser according to the seventh embodiment, wherein the handle includes a cam surface, the crank arm includes a cam follower disposed in operable engagement with the cam surface, the crank includes at least one dispensing finger proximate the next-in-line utensil, and in response to translation actuation of the handle, interaction between the cam surface and the cam follower causes rotation of the crank and dispensing engagement of the at least one finger with the next-in-line utensil.

A ninth embodiment of the invention includes a cutlery dispenser according to the eighth embodiment, wherein the cam surface includes a slot, and the earn follower includes a pin.

A tenth embodiment of the invention includes a cutlery dispenser according to any of the sixth through ninth embodiments, wherein the driving member is biased toward a first position, a rest position, and is actuatable toward a second position to dispense the next-in-line utensil, and in response to the driving member being disposed at its rest position, the driven member is disposed at its respective rest position.

An eleventh embodiment of the invention includes a cutlery dispenser according to the tenth embodiment, further including a spring disposed to bias the driving member toward its rest position, and in response to the driving member being disposed at the second position, the spring biases the driving member toward its rest position and in response thereto, the driving member biases the driven member to its respective rest position.

A twelfth embodiment of the invention includes a cutlery dispenser according to the fourth embodiment, wherein the third zone includes a dispensing tray having an end wall with an opening therethrough for receiving the handle portion of the dispensed utensil therein.

A thirteenth embodiment of the invention includes a cutlery dispenser according to the fourth embodiment, wherein the third zone includes a dispensing tray having a solid end wall for stopping the handle portion of the dispensed utensil.

A fourteenth embodiment of the invention includes a cutlery dispenser according to the thirteenth embodiment, wherein the dispensing tray includes a pocket floor being so configured and dimensioned as to allow a user's fingers to extract a dispensed utensil from the tray without touching a surface of the tray floor supporting the dispensed utensil.

A fifteenth embodiment of the invention includes a cutlery dispenser according to any of the sixth through eleventh embodiments, wherein the dispensing mechanism includes a motor in operable engagement with the driving member, and a switch for actuating the motor in response to a demand for a utensil.

A sixteenth embodiment of the invention includes a cutlery dispenser according to the fifteenth embodiment, wherein the switch includes an infrared sensor.

A seventeenth embodiment of the invention includes a cutlery dispenser according to any of the sixth through eleventh embodiments, wherein the dispensing mechanism includes a motor in operable engagement with the driving member, and a switch for actuating the motor in response to an absence of a utensil in the third zone.

An eighteenth embodiment of the invention includes a cutlery dispenser according to the seventeenth embodiment, wherein the switch includes an infrared sensor.

A nineteenth embodiment of the invention includes a cutlery dispenser according to any of the first through eighteenth embodiments, wherein the first zone and the second zone define a width of the housing that is equal to or less than three times the width of the utensil.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A cutlery utensil dispenser, comprising:

a housing comprising a left panel and a right panel, a first zone for holding a utensil to be dispensed, a second zone for receiving the utensil during dispensing, and a third zone for delivering the dispensed utensil to a user, wherein the utensil has a utensil width;

a dispensing mechanism comprising a driving member operably coupled to a driven member, the driven member being operably disposed to dispense a next-in-line utensil from the first zone to the second zone upon actuation of the driving member, the driven member comprising a crank comprising at least one dispensing finger proximate the next-in-line utensil;

wherein a width of the housing between the left panel and the right panel is determined by a width of the first zone plus a width of the second zone, wherein the width of the housing is equal to or less than three times the utensil width;

the first, second and third zones being cooperatively configured and adapted to maintain, and present to the user, one end of the utensil ahead of an opposing end of the utensil during a dispensing operation;

wherein:

each of the first zone, the second zone and the third zone are adapted and configured to maintain a major axis of the utensil substantially parallel with a y-z plane in relation to a set of orthogonal x-y-z axes, wherein the crank has an axis of rotation oriented parallel with the major axis of the next-in-line utensil;

the first zone is configured to orient the major axis of the utensil substantially parallel to the z-axis;

the second zone being offset from the first zone in a first direction defined by a negative-x direction;

the third zone being offset from the second zone in a second direction defined by a positive-z direction orthogonal to the first direction; and the dispensing mechanism is structurally configured and disposed to facilitate a movement of the major axis of the utensil from the first zone to the second zone in the first direction while maintaining the major axis of the utensil substantially parallel with the y-z plane.

2. The cutlery dispenser of claim 1, wherein:

a next-in-line utensil to be dispensed passes in succession from the first zone to the second zone to the third zone during a dispensing operation.

3. The dispenser of claim 1, wherein the third zone is adapted and configured to present a handle portion of the utensil to the user ahead of a utility portion of the utensil.

4. The dispenser of claim 3, wherein:

the third zone comprises a dispensing tray comprising an end wall with an opening therethrough for receiving the handle portion of the dispensed utensil therein.

5. The dispenser of claim 3, wherein:

the third zone comprises a dispensing tray comprising a solid end wall for stopping the handle portion of the dispensed utensil.

6. The dispenser of claim 5, wherein:

the dispensing tray comprises a pocket floor being so configured and dimensioned as to allow a user's fingers to extract a dispensed utensil from the tray without touching a surface of the tray floor supporting the dispensed utensil.

7. The cutlery dispenser of claim 3, wherein:

the third zone comprises a dispensing tray comprising at least one of a side-wall profile or an end-wall profile configured to present the handle portion of the utensil to the user ahead of the utility portion, configured to maintain the handle portion oriented for presentation to the user, and configured to maintain the major axis of the utensil substantially parallel with the y-z plane.

8. The dispenser of claim 7, wherein:

the third zone comprises a dispensing tray comprising an end wall with an opening therethrough for receiving the handle portion of the dispensed utensil therein.

9. The dispenser of claim 1, wherein the second zone comprises a ramp configured and disposed to dispense the utensil toward the third zone under the influence of gravity.

10. The dispenser of claim 1, wherein:

the driving member comprises a manually actuatable handle;

the crank comprises a crank arm coupled to the handle; and in response to actuation of the handle, the crank is actuated via the crank arm to dispense the next-in-line utensil.

11. The dispenser of claim 10, wherein:

the handle comprises a cam surface;

the crank arm comprises a cam follower disposed in operable engagement with the cam surface; and in response to translation actuation of the handle, interaction between the cam surface and the cam follower causes rotation of the crank and dispensing engagement of the at least one finger with the next-in-line utensil.

12. The dispenser of claim 11, wherein:

the cam surface comprises a slot; and the cam follower comprises a pin.

13. The dispenser of claim 1, wherein:

the driving member is biased toward a first position, a rest position, and is actuatable toward a second position to dispense the next-in-line utensil; and in response to the driving member being disposed at its rest position, the driven member is disposed at its respective rest position.

14. The dispenser of claim 13, further comprising:

a spring disposed to bias the driving member toward its rest position; and in response to the driving member being disposed at the second position, the spring biases the driving member toward its rest position and in response thereto, the driving member biases the driven member to its respective rest position.

15. The dispenser of claim 1, wherein:

the dispensing mechanism comprises a motor in operable engagement with the driving member; and a switch for actuating the motor in response to a demand for a utensil.

16. The dispenses of claim 15, wherein:

the switch comprises an infrared sensor.

17. The dispenser of claim 1, wherein:

the dispensing mechanism comprises a motor in operable engagement with the driving member; and a switch for actuating the motor in response to an absence of a utensil in the third zone.

18. The dispenser of claim 17, wherein:

the switch comprises an infrared sensor.

19. The cutlery dispenser of claim 1, wherein:

the third zone comprises a dispensing tray comprising at least one of a side-wall profile or an end-wall profile configured to present the one end of the utensil to the user ahead of the opposing end, configured to maintain the one end oriented for presentation to the user, and configured to maintain the major axis of the utensil substantially parallel with the y-z plane.

* * * * *